US009968150B2

(12) United States Patent
Curbeon

(10) Patent No.: US 9,968,150 B2
(45) Date of Patent: May 15, 2018

(54) HAIR EXTENSION

(71) Applicant: Daisy Curbeon, New York, NY (US)

(72) Inventor: Daisy Curbeon, New York, NY (US)

( * ) Notice: Subject to any disclaimer, the term of this patent is extended or adjusted under 35 U.S.C. 154(b) by 0 days. days.

(21) Appl. No.: 14/215,424

(22) Filed: Mar. 17, 2014

(65) Prior Publication Data

US 2015/0257469 A1 Sep. 17, 2015

(51) Int. Cl.
*A41G 5/00* (2006.01)

(52) U.S. Cl.
CPC ..... *A41G 5/0053* (2013.01); *A41G 5/0046* (2013.01)

(58) Field of Classification Search
CPC . A41G 3/00; A41G 5/00; A41G 5/004; A41G 5/0093
USPC ..... 132/53–56
See application file for complete search history.

(56) References Cited

U.S. PATENT DOCUMENTS

| | | | | |
|---|---|---|---|---|
| 4,285,350 | A | 8/1981 | Cox | |
| 4,600,029 | A * | 7/1986 | Ueberschaar | 132/53 |
| 5,551,452 | A * | 9/1996 | Barlow | 132/54 |
| 6,830,054 | B1 * | 12/2004 | Ross-Kuehn | 132/201 |
| 8,578,946 | B2 | 11/2013 | Ellery | |
| 8,739,803 | B2 * | 6/2014 | Freelove | 132/53 |
| 2004/0168696 | A1 | 9/2004 | Cox | |
| 2006/0174905 | A1 * | 8/2006 | Bias | A41G 5/0093 132/53 |
| 2009/0241974 | A1 * | 10/2009 | Hampton | 132/54 |
| 2010/0065078 | A1 * | 3/2010 | Reece | 132/54 |
| 2011/0168196 | A1 * | 7/2011 | Freelove | 132/53 |

* cited by examiner

*Primary Examiner* — Rachel Steitz
(74) *Attorney, Agent, or Firm* — Vincent Re PLLC

(57) ABSTRACT

What is claimed is an natural hair extension. The hair extension is formed with a foundation of an elastic mesh into which wefts of natural hair are sewn. The elastic may also be covered by a ribbon to prevent irritation of the scalp.

3 Claims, 14 Drawing Sheets

10

HAIR EXTENSION

BACKGROUND OF THE INVENTION

The present invention is directed to the field of hair styling. In particular, the present invention is directed to the field of supplemental hair fabricated from natural hair. The hair extensions of the present invention are adapted to be used in conjunction with a person's natural hair. The hair extensions of the present invention can be adapted so that the person's natural hair is blended with the hair extension. Thereby the hair extension of the present invention blends naturally and seamlessly with the person's natural hair.

SUMMARY OF THE INVENTION

A natural hair extension comprising a foundation comprising circular elastic mesh forming a periphery, a plurality of wefts of natural hair sewn into the periphery formed by the elastic mesh and extending downward therefrom; and one or more openings in the wefts around the periphery wherein the natural hair extension can be placed tightly onto the user's head and formed into various hair styles with the user's hair.

DETAILED DESCRIPTION OF THE INVENTION

Figure 1:
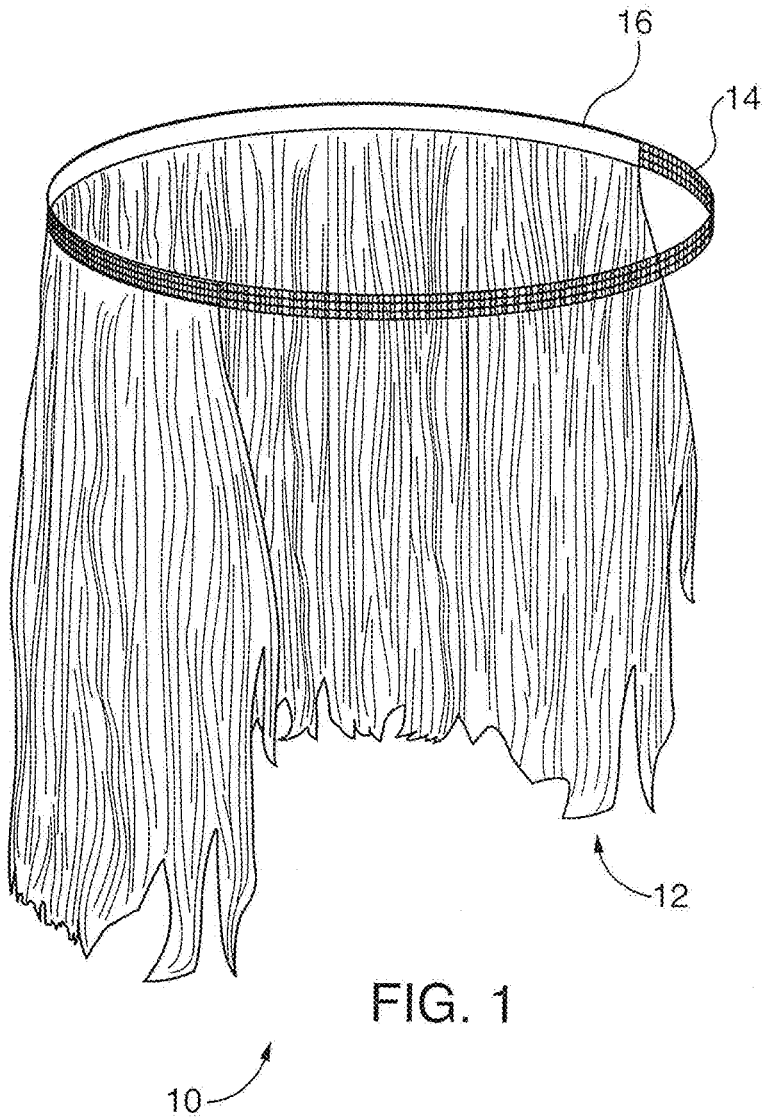
FIG. 1 is a plan view of the first embodiment of the present invention.

The present invention will now be described in terms of the presently preferred embodiments thereof as illustrated in the drawings. Those of ordinary skill in the art will recognize that many obvious modifications may be made thereto without departing from the spirit or scope of the present invention.

Figure 2:
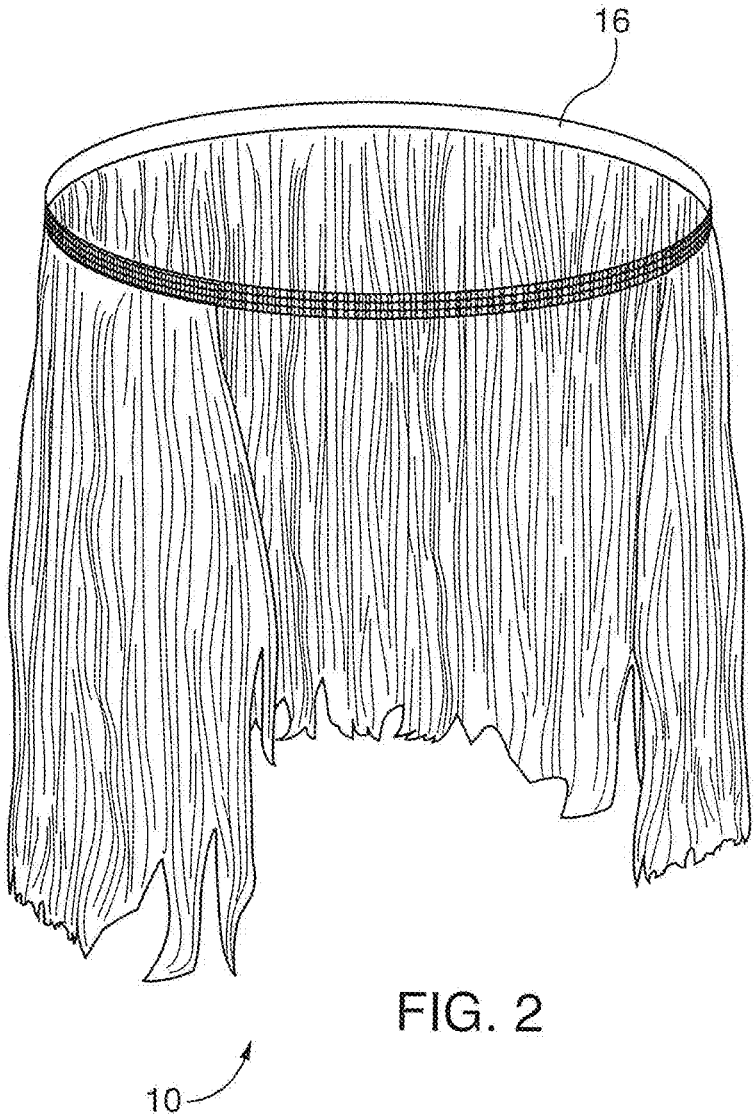
FIG. 2 is a plan view of the first embodiment of the present invention.

FIG. 1 illustrates a first embodiment (10) of the present invention which is directed to creating bangs for the user. This embodiment is made with 2 wefts (12) of natural hair. The wefts are sewn into an elastic band (14) on a zig-zag sewing machine and are sewn together using a zig-zag stitch. The wefts are very thin and flat to blend with the person's natural hair. One weft can be used for a flat extension. Alternatively, 2 to 4 wefts can be incorporated for greater fullness of the hair and more flexible designs. A ribbon (16) is placed on top of the weft and attached to the wefts by using a straight stitch at the sides, top and bottom of the ribbon. The ribbon is sewn on top of the weft to protect the person's scalp from irritation due to the foundation of the weft root and/or for those who are bald, balding, or with thin hair. The ribbon can be dyed to match the user's hair color and turned face out from the head to blend with the natural hair for those with thin hair. The elastic (14) which comprises a mesh which can also be dyed to match the user's hair color is left open without hair at the back of the head to securely fit to the head. Thus, no clips, bobby pins, hair pins, glue or bonding or sewing to the person's natural hair are used. This elastic mesh sits on the head and scalp and fits close to the head like a glove. The ribbon is folded, the elastic mesh is sewn inside of each side as indicated above to allow for stretching and flexibility when fitting to the person's head. The elastic mesh is stretched more than usual when the ribbon is being attached for a user who is bald (as in those with cancer) or balding for comfort. FIG. 2 illustrates a different perspective view of the first embodiment (10) with a ribbon on the inside of the wefts rather than on the outside as in FIG. 1. The bangs in this embodiment (10) are approximately 18 inches in circumference around the head with an open back of approximately 6½ inches.

Figure 3:
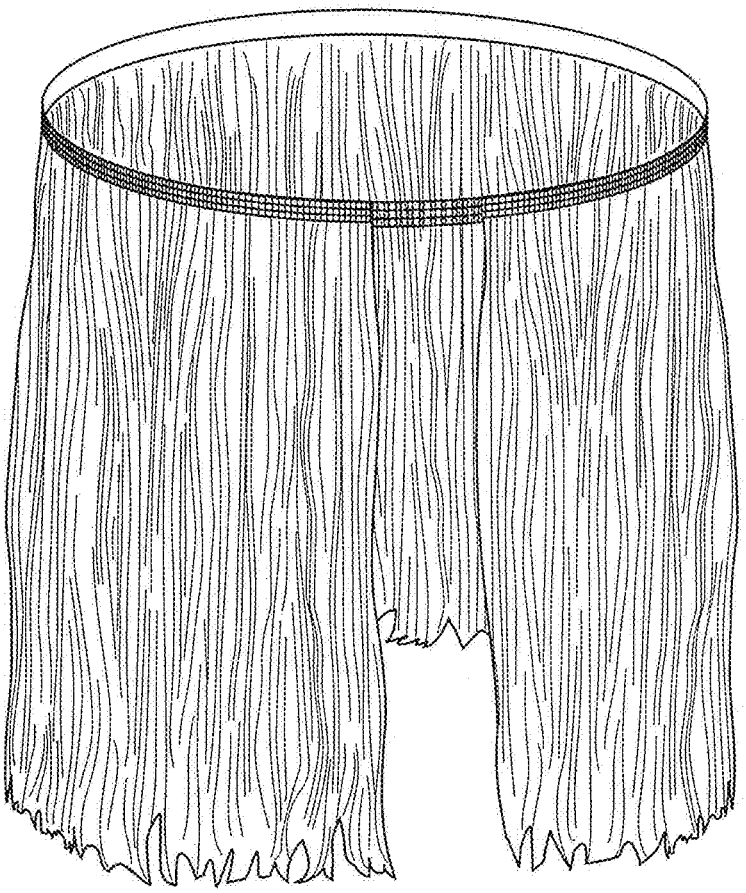
FIG. 3 is a plan view of the first embodiment of the present invention.

FIG. 3 illustrates the first embodiment, with an elastic mesh. FIG. 3 illustrates an approximate 2 inch opening, which allows the user to style the embodiment to create full bangs and a full set of hair on the back of the head.

Figure 4:
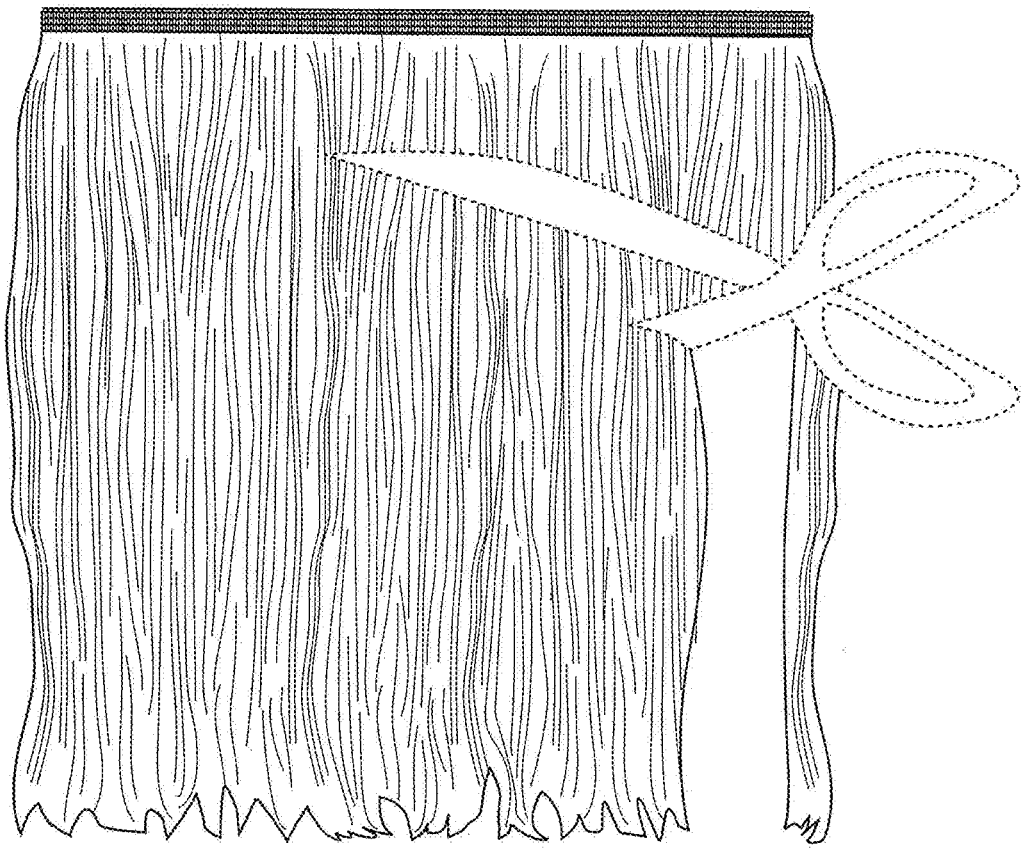
FIG. 4 is an illustration of one manner of using the first embodiment of the present invention.

FIG. 4 illustrates the first embodiment with the bangs cut out from the circle that is approximately 10 inches in diameter. This embodiment can be used by forming the longer hair as a ponytail with the bangs cut to a style chosen by the user.

Figure 5:
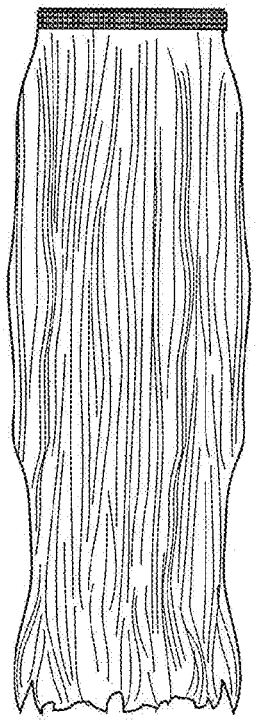
FIG. 5 is a plan view of the second embodiment of the present invention.
Figure 6:
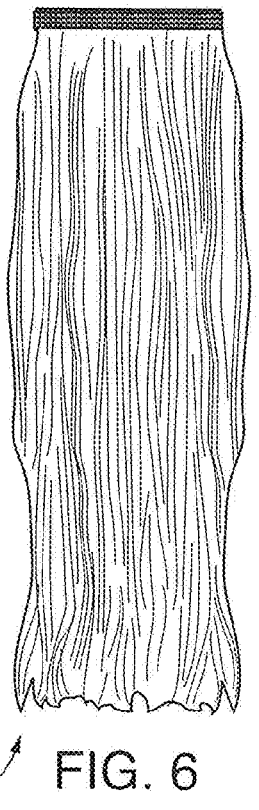
FIG. 6 is a plan view of a second embodiment of the present invention.

FIGS. 5 & 6 illustrate the bangs (10) in a circle with no hair in the back. This embodiment of the bangs can be used in either direction resulting in hair in the back or front depending upon the user's choice of style. This embodiment comprises the ribbon or satin sewn across the weft root to protect the scalp. If the user has thin hair and sensitive scalp, it is best to wear the ribbon towards the scalp. If the hair is strong and the scalp is not as sensitive, the weft can lay against the scalp.

Figure 7:
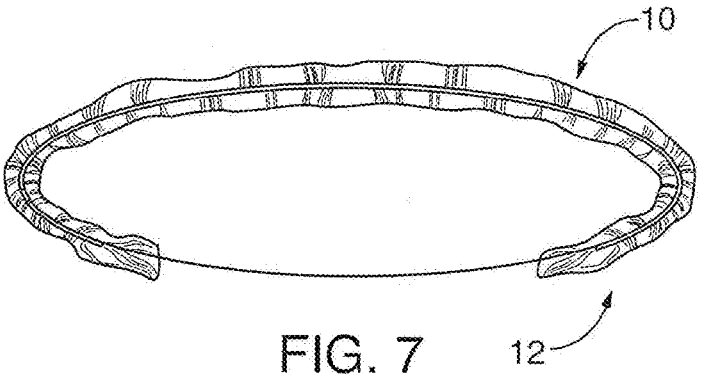
FIG. 7 is a plan view of the second embodiment of the present invention.

FIG. 7 shows the foundation (12) of the bangs (10) before any hair or weft is added. The foundation comprises the ribbon (16) sewn around it to protect the scalp, blend with the natural hair color and give a finished look. The ribbon and the elastic mesh are sewn together.

Figure 8:
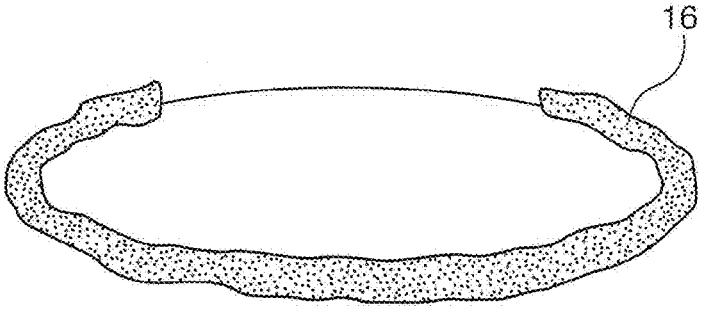
FIG. 8 is part of a second manner of use of the first embodiment of the present invention.

FIG. 8 illustrates the bangs in a full circle with the back cut open and the ribbon (16) sewn around the entire circumference. The ribbon (16) is folded on each side where the elastic mesh is placed and sewn therein, thus leaving approximately a 2 inch opening in the back.

Figure 9:
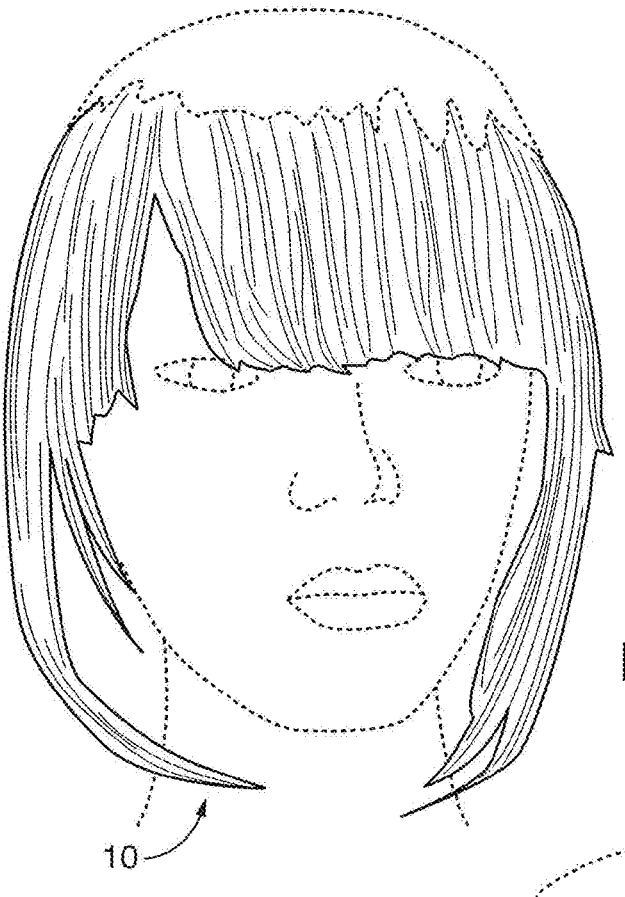
FIG. 9 illustrates a use of the present invention.

FIG. 9 illustrates the bangs (10) open with a ribbon inside to protect the scalp.

Figure 10:
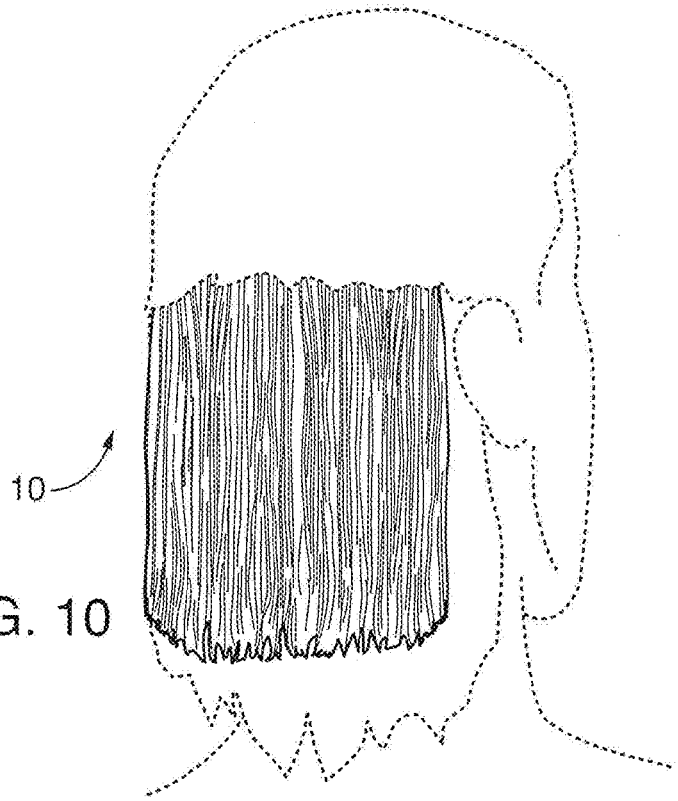
FIG. 10 illustrates a use of the present invention.

FIG. 10 illustrates the bangs (10) placed on the head with a full back and front around the full circumference of the head. The user's natural hair is blended into the bangs (10). This use provides a fuller and longer front and back for a user with thin hair or users who just want a different hair color mixed into their natural hair.

Figure 11:
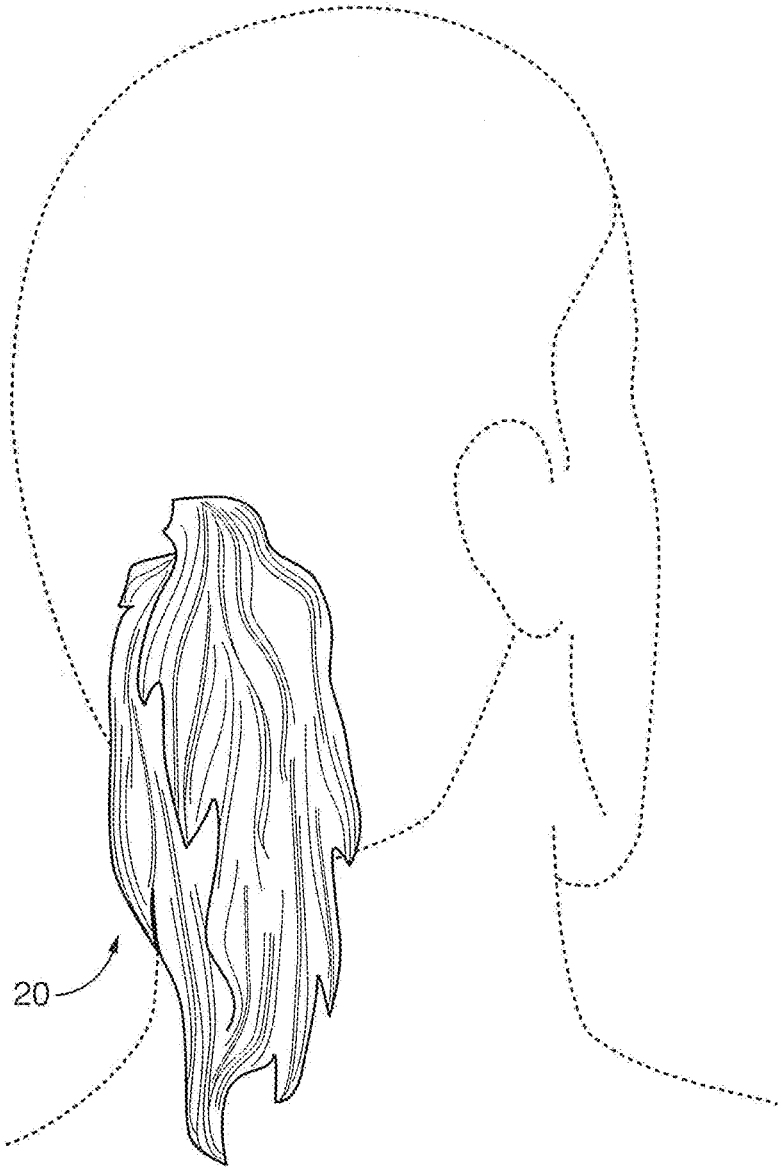
FIG. 11 illustrates a use of the present invention.

FIG. 11 shows the use of a second embodiment (20) referred to as a hair pineapple (20) which is fabricated with 2 wefts of natural hair. The wefts are sewn together side by side with a middle insert of elastic mesh. The first weft of natural hair is placed face down and the hair is facing outward as the elastic mesh is sewn in a zig-zag motion. The elastic mesh is pulled front and back as it is sewn together which gives it an accordion like look and feel. The second weft of natural hair is then placed on the other side of the elastic mesh and is sewn together. The hair is facing outward and the elastic mesh is in the middle. The hair is facing right and left of the elastic mesh. When the stitching is complete and it is stretched out it measures approximately 10 inches, is a circle folded over on itself and is approximately 20 inches when completely stretched. The pineapple can be used as a ponytail or used to cover the entire head to provide fullness of hair. The natural hair can be made in any color or texture and give highlights to the natural hair by blending the pineapple into the natural hair.

FIG. 11 shows the pineapple formed as a ponytail. The user takes their natural hair and pulls it up in a rubber band or elastic band. The user then takes the pineapple and turns it around the ponytail 3 times until tight and firm into the desired hairstyle. In the alternative, this embodiment, a rabbit's tail, can be created without closing the ends in a full circle and leaving it in a straight configuration. By creating this embodiment, the user with very short hair can make a small ponytail and attach one end of this embodiment with a bobby pin or hair pin and wrap it around the ponytail and attach the opposite end to the ponytail with another bobby pin or hair pin and have a longer ponytail, braided or styled as desired.

Figure 12:
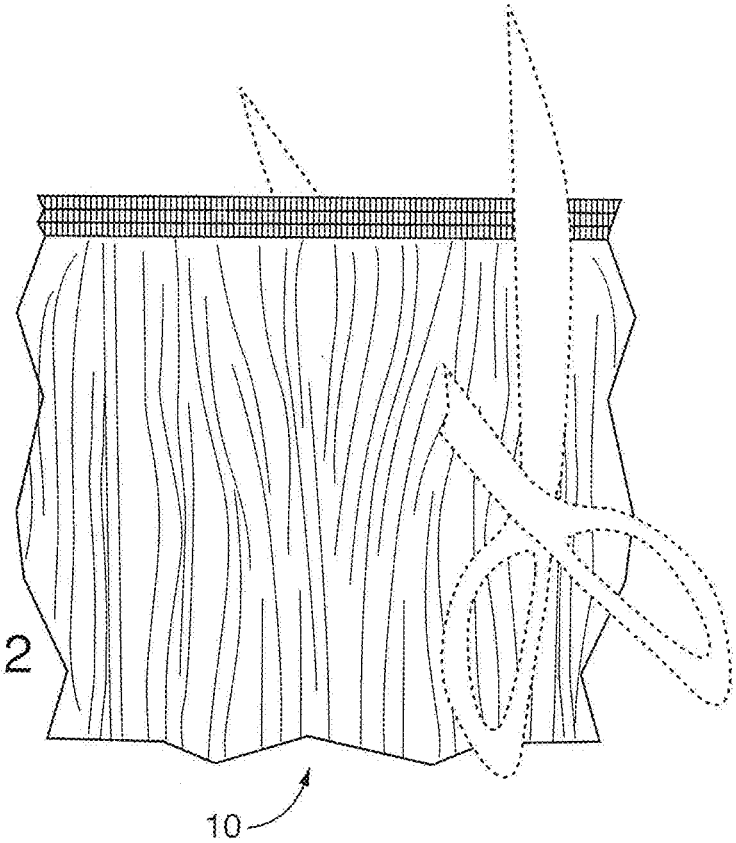
FIG. 12 illustrates a use of the second embodiment.
Figure 13:
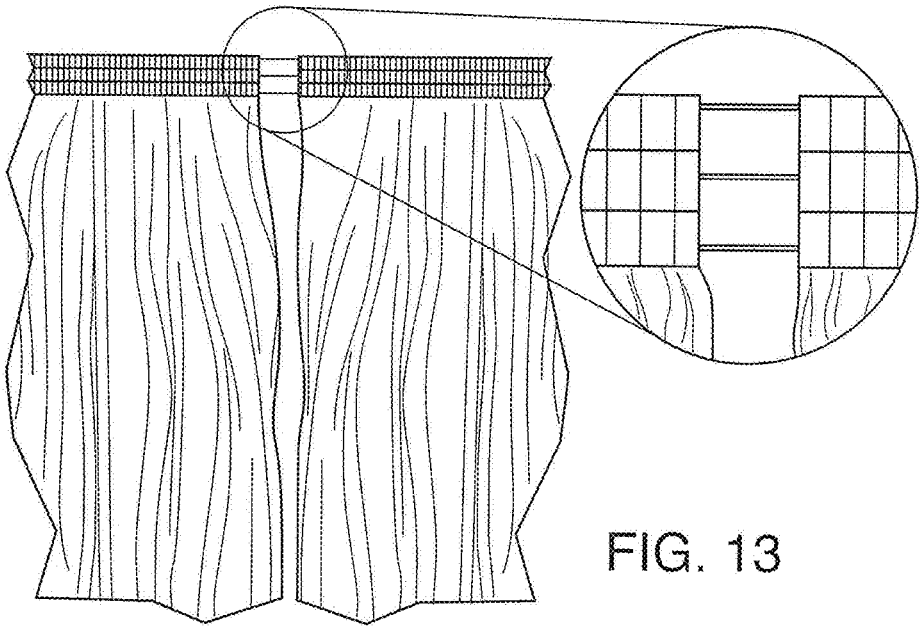
FIG. 13 is a detail view of a part of the second embodiment.

FIGS. 12 & 13 illustrate an alternative embodiment with the same specifications as FIG. 1 except that the there would be a space of approximately ½ to ¼ inch where the elastic mesh would be replaced by a filament thread in three places, the wefts should not incorporated into these areas, to allow for a part in the user's natural hair. Specifically, FIG. 12 shows the bangs being cut at the root of the weft and mesh to prepare it for an open part. The creation of a part in the user's hair is illustrated in FIG. 14.

FIG. 13 more specifically illustrates the area of the weft where the bangs are cut into the root and weft creating an area for the part in the bangs. The filament thread sewn in the right and left of the wefts root into the mesh which is strong and cannot be broken by combing, brushing or pulling. The thread is sewn into the root of the weft with a straight stitch and the thread is wrapped around the needle and pulled. This is called a double stitch. This filament thread allow the client with a natural middle part or left, right part the freedom to style the hair with a middle, left and right part. FIG. 13 further illustrates 3 pieces of filament thread across the wefts sewn inside the root and foundation. If the client has 2 wefts then 2 filament threads will be attached by sewing the thread to the wefts at the mesh on each side. If 1 weft is used, 1 filament thread is attached, if 2 wefts are used, 2 threads are used and if 3 wefts are used, 3 threads are used for stabilization. The filament thread is clear and invisible and will not be seen in the scalp because the natural hair will blend into the thread. The filament thread is available in different colors and thickness should the user determine color would be a more appropriate choice for blending with the hair.

FIG. 12 illustrates the bangs (10) in a circle which will go around the entire head of the user. In this use, the bangs are cut as bangs with a piece of the circumference having natural hair for the back of the head. FIG. 13 is the same as FIG. 12 with the outside of the ribbon to cover the weft root. The elastic mesh is dyed to match the hair color.

Figure 14:
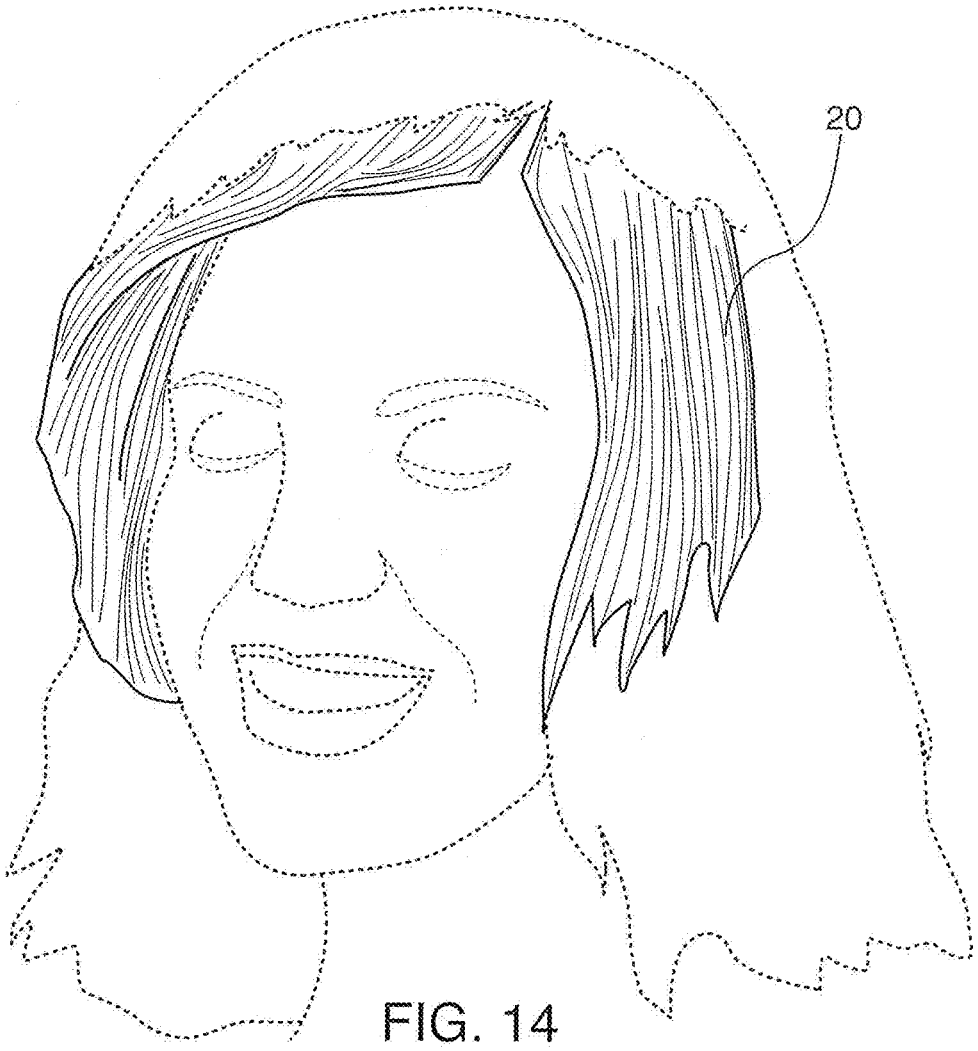
FIG. 14 illustrates a use of the second embodiment of the present invention.

FIG. 14 shows the pineapple (20) made in an approximate 20 inch circle covering the entire head where the user's natural hair line will lay. The pineapple can also be combed over the hair line to cover the roots of the user's hair and the foundation of the pineapple. The crown of the hair blended into the pineapple and around the back of the head. In this way, the pineapple can be combed, cut and blended into the natural hair. The bangs (10) can also be styled with a part as in FIG. 14.

Figure 15:
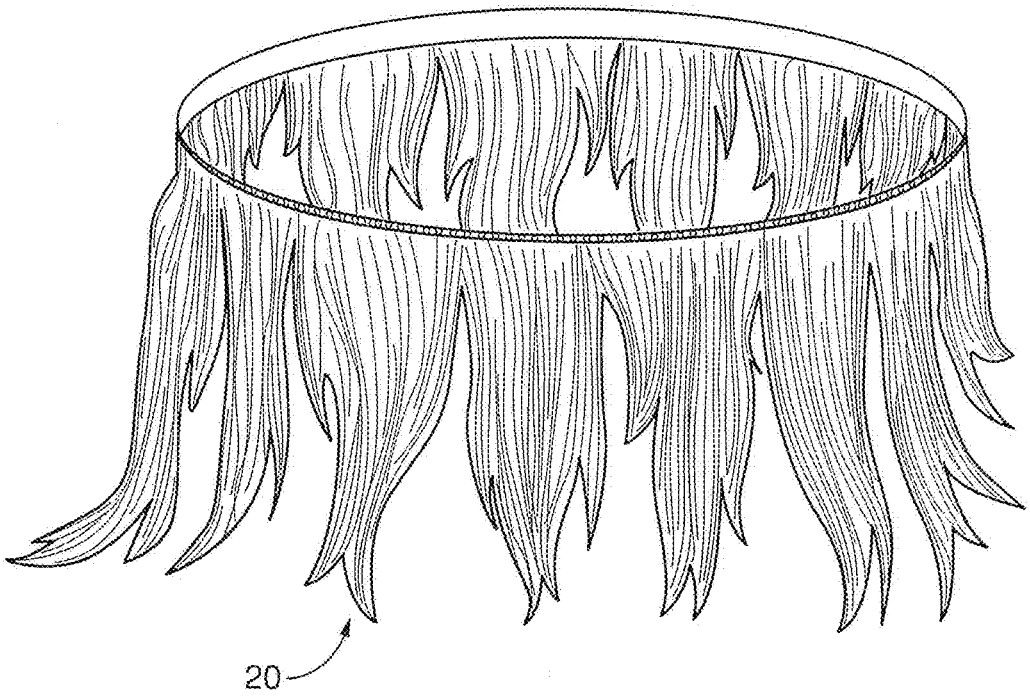
FIG. 15 illustrates a third embodiment of the present invention.

FIG. 15 illustrates the pineapple (20) in a full circle of approximately a 20 inch circumference to go around the entire head. This variation comprises elastic mesh sewn with a weft track being held tightly in the left hand and pulled to stretch it with the right hand while sewing with a zig-zag stitch.

Figure 16:
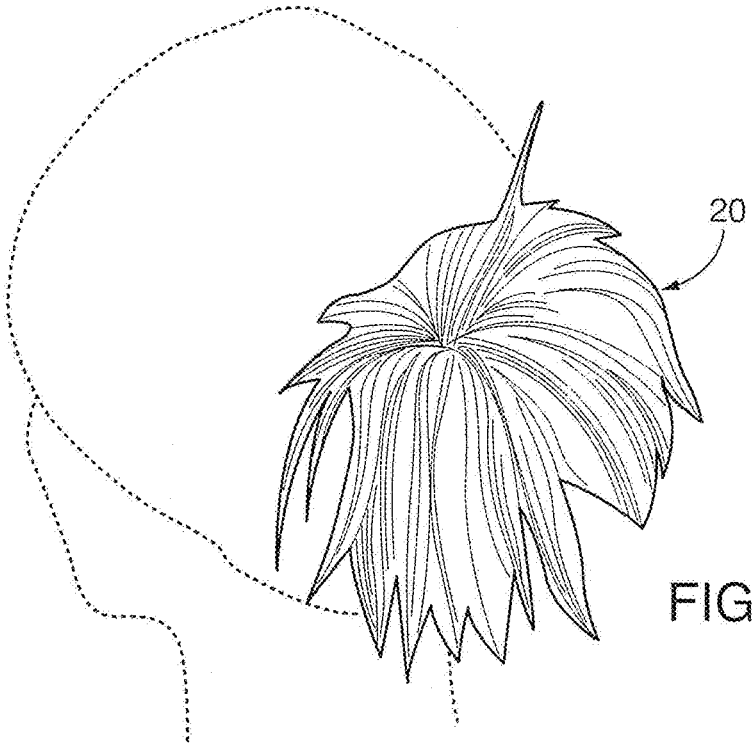
FIG. 16 illustrates a use of the third embodiment of the present invention.

FIG. 16 shows the pineapple (20) formed with a ponytail that can be of various sizes or circumference.

Figure 17:
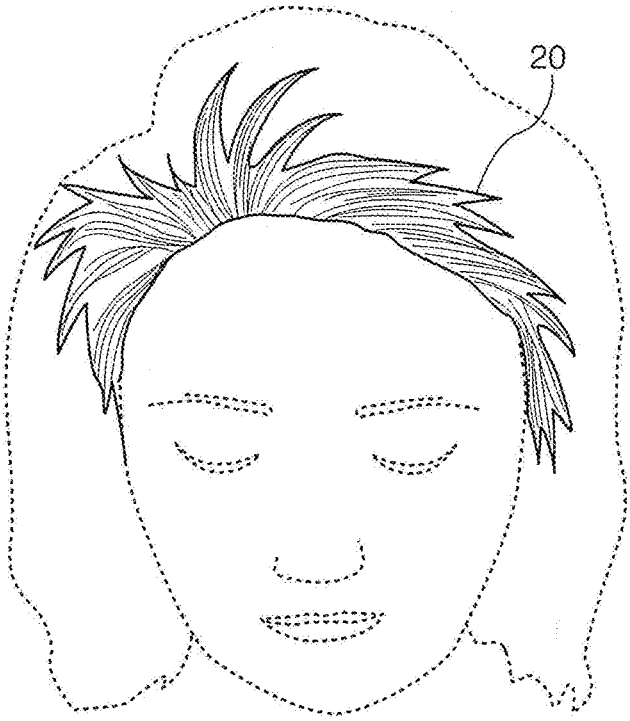
FIG. 17 illustrates a use of the third embodiment of the present invention.

FIG. 17 shows the pineapple (20) that can be used to cover the entire head. The user's natural hair line covers the root of the pineapple or the root of the pineapple can be visible. This pineapple covers the entire front and back of the head. The pineapple around the entire head is used to style the user's natural hair and cover the weft roots of the pineapple.

Figure 18:
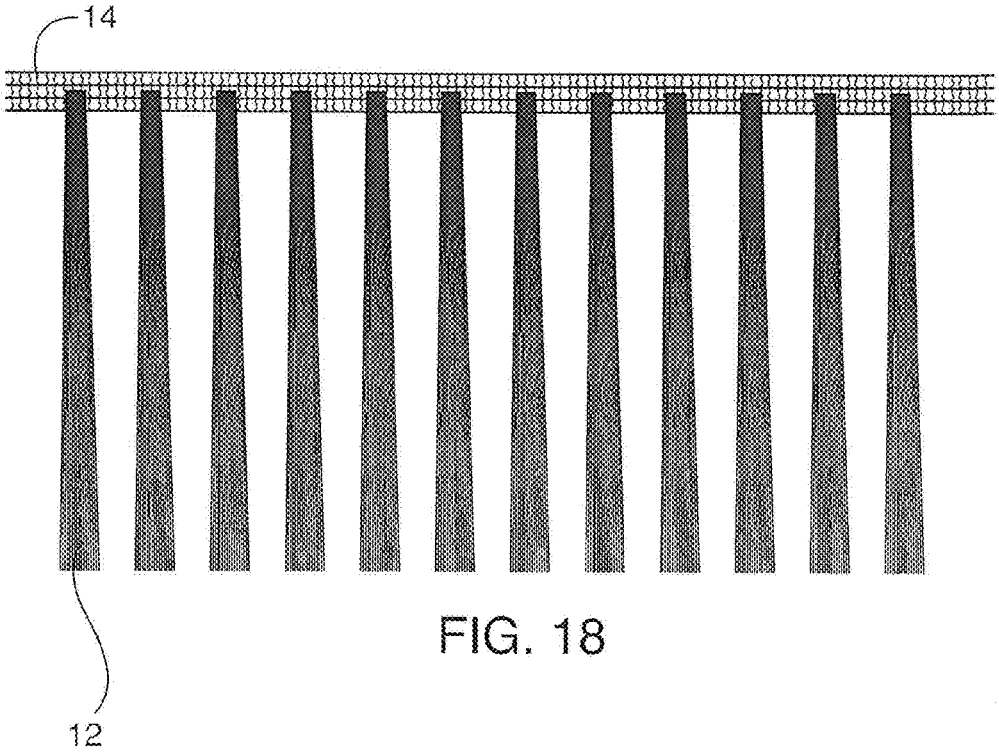
FIG. 18 illustrates a manner of fabricating the third embodiment.

FIG. 18 illustrates the elastic mesh fabricated with hair ventilated techniques used. All of the above designs can be made with this technique and/or with a weft track. FIG. 18 illustrates the elastic mesh formed with the hair by a needle and tied with a fisherman's knot.

Figure 19:
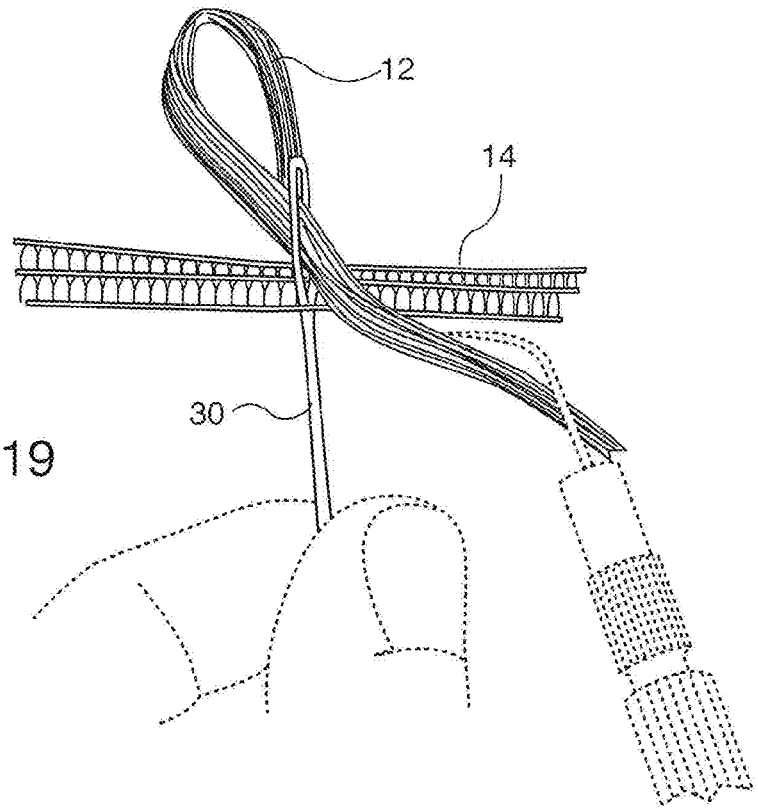
FIG. 19 illustrates a manner of fabricating the third embodiment.

FIG. 19 illustrates how the natural hair (12) is attached to the elastic mesh (14) with a needle/ventilating needle (20). The hair is inserted through the eye of the needle and inserted into the elastic mesh, pulled through the mesh and knotted 2-3 times and pulled until the hair is flat.

Figure 20:
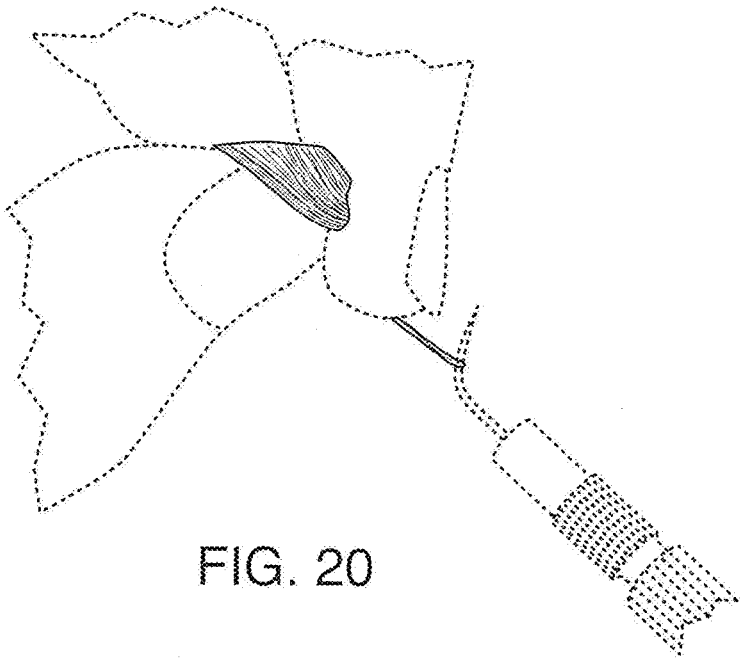
FIG. 20 illustrates a manner of fabricating the third embodiment.

FIG. 20 illustrates a needle hooked into the hair. One hand holds the hair tight and then by turning the other hand 2-3 times results in the needle turning inside the elastic mesh. The needle is then pulled until the hair is straight and tight resulting in very small knots. This is done until the entire bang, ponytail and/or rabbit's tail is done.

Figure 21:
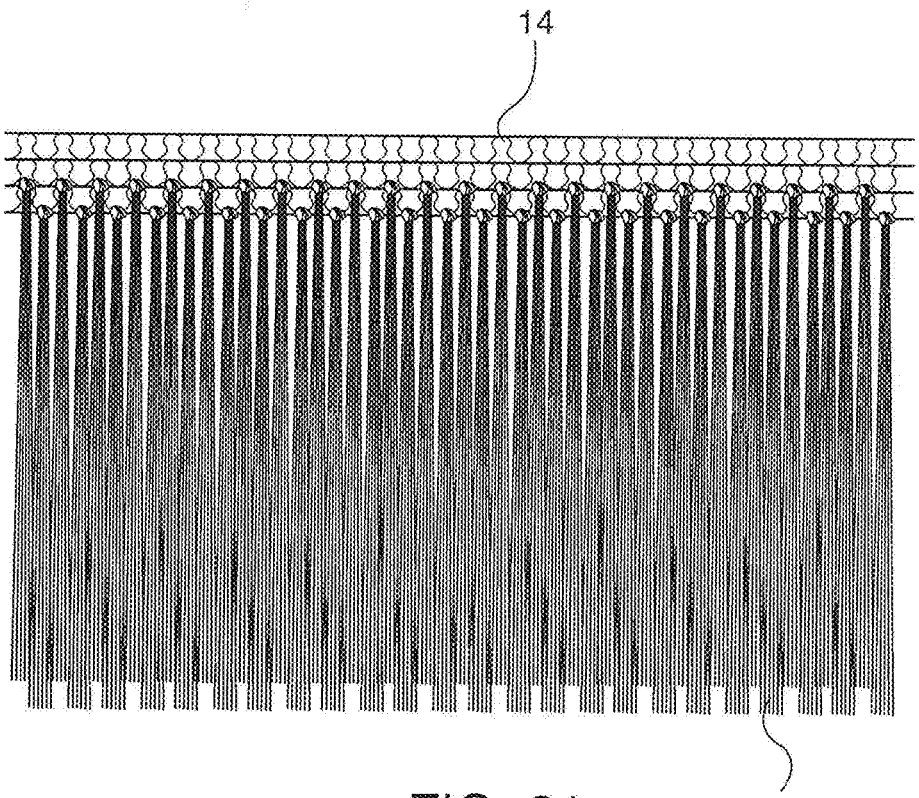
FIG. 21 illustrates a fourth embodiment of the present invention.

FIG. 21 illustrates an alternate embodiment where the elastic mesh (14) with the ventilating and needle work are done with hair (12) on the entire elastic mesh. This embodiment can be used as a bang design from ear to ear or in an entire circle front to back with a 1 inch opening and can be used to fabricate the pineapple as well.

Figure 22:
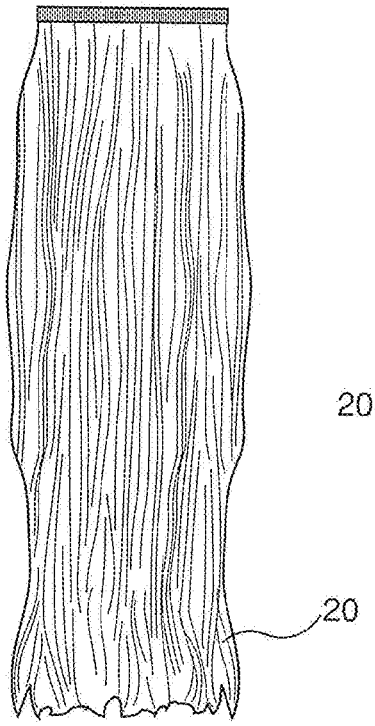
FIG. 22 is a plan view of the second embodiment of the present invention.
Figure 23:
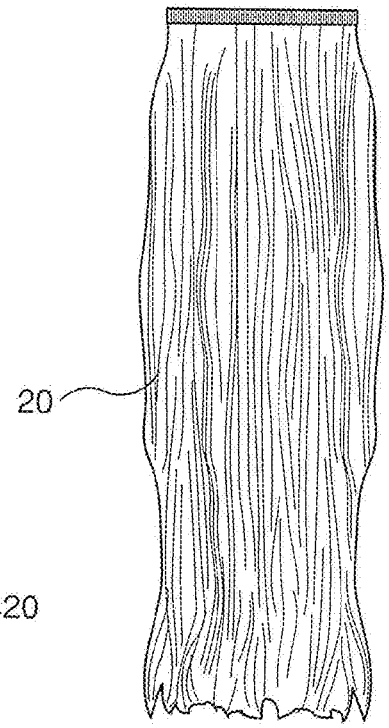
FIG. 23 is a plan view of a second embodiment of the present invention.

FIGS. 22 and 23 illustrate views of the small circle for the pineapple (20) with elastic mesh on the entire circle sewn with the weft or ventilating or needle technique. This embodiment can also be formed in the same manner illustrated in FIGS. 12 and 13 to create a part in the user's natural hair.

Figure 24:
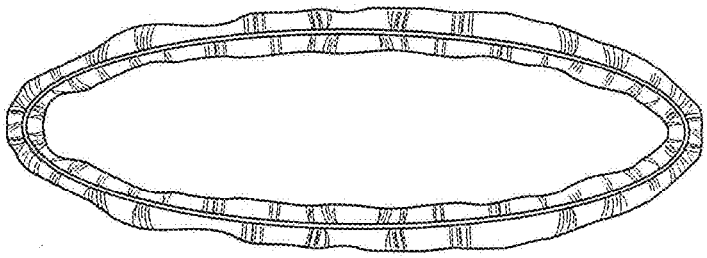
FIG. 24 is a plan view of a part of the second embodiment of the present invention.

FIG. 24 shows a full circle with the elastic mesh in full circle. This can be used as the foundation of the ponytail and will attach to the foundation of FIG. 21 and will have an elastic mesh to create a ponytail that can be pulled and stretched.

Figure 25:
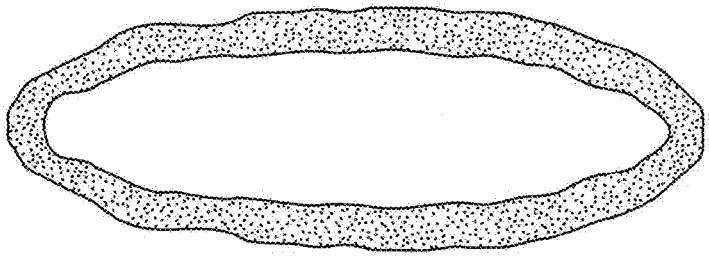
FIG. 25 is part of a second embodiment of the present invention.

FIG. 25 illustrates the back of the elastic mesh for the embodiment shown in FIGS. 22 and 23 which is the foundation of the ponytail and the back of the root of the design that allows the natural hair to be covered.

Those of ordinary skill in the art will recognize that the foregoing merely represents an embodiment of the present invention. Many obvious modifications may be made thereto without departing from the spirit or scope of the present invention as set forth in the appended claims.

What is claimed is:

1. A natural hair extension comprising:

a foundation comprising:

a flat circular elastic mesh forming a periphery, wherein the mesh comprises:

elastic mesh elements; and holes between the elastic mesh elements; and natural hair woven into a first portion of the flat circular elastic mesh and extending downward therefrom; and a ribbon attached to an interior of the first portion of the flat circular elastic mesh, covering every point where the natural hair is woven into the flat circular elastic mesh, and configured to protect a scalp of a user from contacting the natural hair, wherein the ribbon covers the interior of the first portion of the flat circular elastic mesh and leaves uncovered an interior of a second portion of the flat circular elastic mesh; and wherein the elastic mesh is configured to stretch when the foundation is applied to a head of the user;

wherein the elastic mesh is further configured to contract after the foundation is applied to the head of the user;

wherein, as the second portion of the elastic mesh contracts upon the head of the user, the elastic mesh elements and the holes of the second portion grip to hairs of the user; and wherein the ribbon prevents the first portion of the flat circular elastic mesh from stretching and disturbing the natural hair woven to the first portion of the flat circular elastic mesh.

2. The natural hair extension of claim 1 wherein the plurality of wefts are sewn into the flat elastic mesh by a zig-zag stitch.

3. The natural hair extension of claim 1 formed from 2 wefts of hair wherein the wefts are sewn together side by side with a middle insert of flat elastic mesh.

* * * * *